US009531078B2

(12) United States Patent
Taptic et al.

(10) Patent No.: US 9,531,078 B2
(45) Date of Patent: Dec. 27, 2016

(54) WIRELESS COMMUNICATION APPARATUS

(71) Applicant: RF elements s.r.o., Bratislava (SK)

(72) Inventors: Juraj Taptic, Zalesie (SK); Martin Marcincak, Jasenov (SK)

(73) Assignee: RF ELEMENTS S.R.O., Bratislava (SK)

( * ) Notice: Subject to any disclaimer, the term of this patent is extended or adjusted under 35 U.S.C. 154(b) by 208 days.

(21) Appl. No.: 14/285,887

(22) Filed: May 23, 2014

(65) Prior Publication Data

US 2014/0347237 A1 Nov. 27, 2014

Related U.S. Application Data

(60) Provisional application No. 61/827,173, filed on May 24, 2013.

(51) Int. Cl.
*H01Q 13/02* (2006.01)
*H01Q 19/13* (2006.01)
*H01Q 21/28* (2006.01)

(52) U.S. Cl.
CPC ..... *H01Q 13/02* (2013.01); *H01Q 19/134* (2013.01); *H01Q 21/28* (2013.01)

(58) Field of Classification Search
CPC ..... H01Q 13/02; H01Q 19/134; H01Q 9/0407
USPC ..... 343/786, 772
See application file for complete search history.

(56) References Cited

U.S. PATENT DOCUMENTS 6,061,026 A * 5/2000 Ochi ..... H01Q 9/285 343/700 MS
6,956,530 B2 * 10/2005 Kadambi ..... H01Q 1/243 343/702
7,852,270 B2 * 12/2010 Yamada ..... H01Q 13/02 343/700 MS
8,564,492 B2 * 10/2013 Mast ..... H05K 1/0278 343/772
8,957,820 B2 * 2/2015 Yamada ..... H01Q 13/06 343/786
2011/0309985 A1 * 12/2011 He ..... H01Q 1/38 343/700 MS

* cited by examiner

*Primary Examiner* — Hoang V Nguyen
(74) *Attorney, Agent, or Firm* — Ohlandt, Greeley, Ruggiero & Perle, LLP

(57) ABSTRACT

There is provided a wireless communication apparatus that includes (a) a printed circuit board, (b) a radio frequency circuit installed on the printed circuit board, and (c) an antenna element that is integrated onto the printed circuit board and electrically coupled to the radio frequency circuit via a printed conductor.

5 Claims, 11 Drawing Sheets

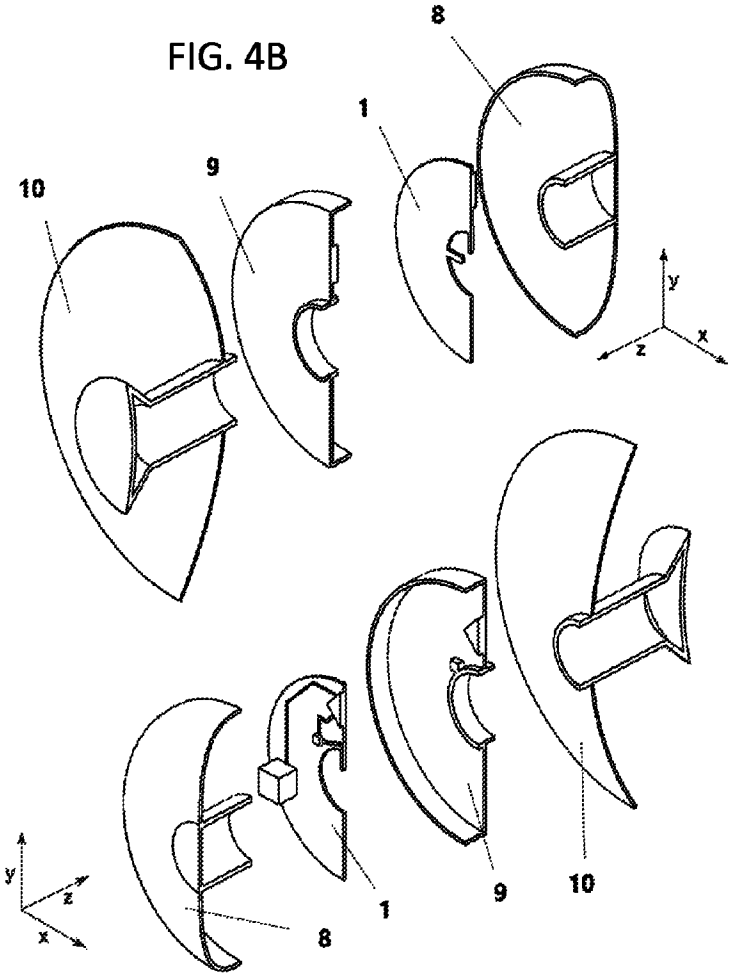
FIG. 4B
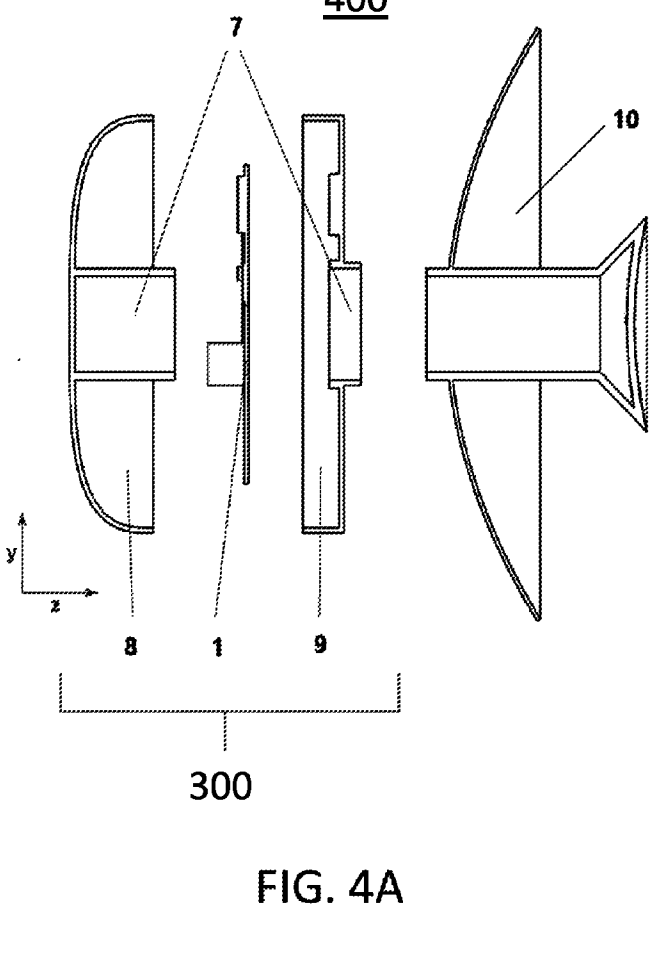
FIG. 4C
FIG. 4A

WIRELESS COMMUNICATION APPARATUS

CROSS-REFERENCE TO RELATED APPLICATIONS

The present application is claiming priority of U.S. Provisional Patent Application Ser. No. 61/827,173, filed on May 24, 2013, the content of which is herein incorporated by reference.

BACKGROUND OF THE DISCLOSURE

1. Field of the Disclosure

The present disclosure relates to antennas, and more particularly, to a configuration of an antenna for a wireless station in a wireless network.

2. Description of the Related Art

The approaches described in this section are approaches that could be pursued, but not necessarily approaches that have been previously conceived or pursued. Therefore, the approaches described in this section may not be prior art to the claims in this application and are not admitted to be prior art by inclusion in this section.

In a conventional wireless station, an electronic unit, e.g., a circuit, is coupled to an antenna by way of a coaxial cable and a connector. Such a configuration includes several undesirable factors associated with the coaxial cable and the connector, such as signal attenuation, intermodulation, signal leakage, and cost of the coaxial cable and the connector.

There is a need for a wireless station that minimizes usage of coaxial cables and connectors.

SUMMARY OF THE DISCLOSURE

It is an object of the present disclosure to provide for a wireless station that minimizes usage of coaxial cables and connectors.

To fulfill this objective, there is provided a wireless communication apparatus that includes (a) a printed circuit board, (b) a radio frequency circuit installed on the printed circuit board, and (c) an antenna element that is integrated onto the printed circuit board and electrically coupled to the radio frequency circuit via a printed conductor.

BRIEF DESCRIPTION OF THE DRAWINGS

FIGS. 4A-4C are exploded views of an apparatus that utilizes the wireless station of FIG. 3.

A component or a feature that is common to more than one drawing is indicated with the same reference number in each of the drawings.

DESCRIPTION OF THE DISCLOSURE

Each of the drawings includes a representation of at least two axes of an xyz coordinate system that show how the drawings relate to one another.

Figure 1:
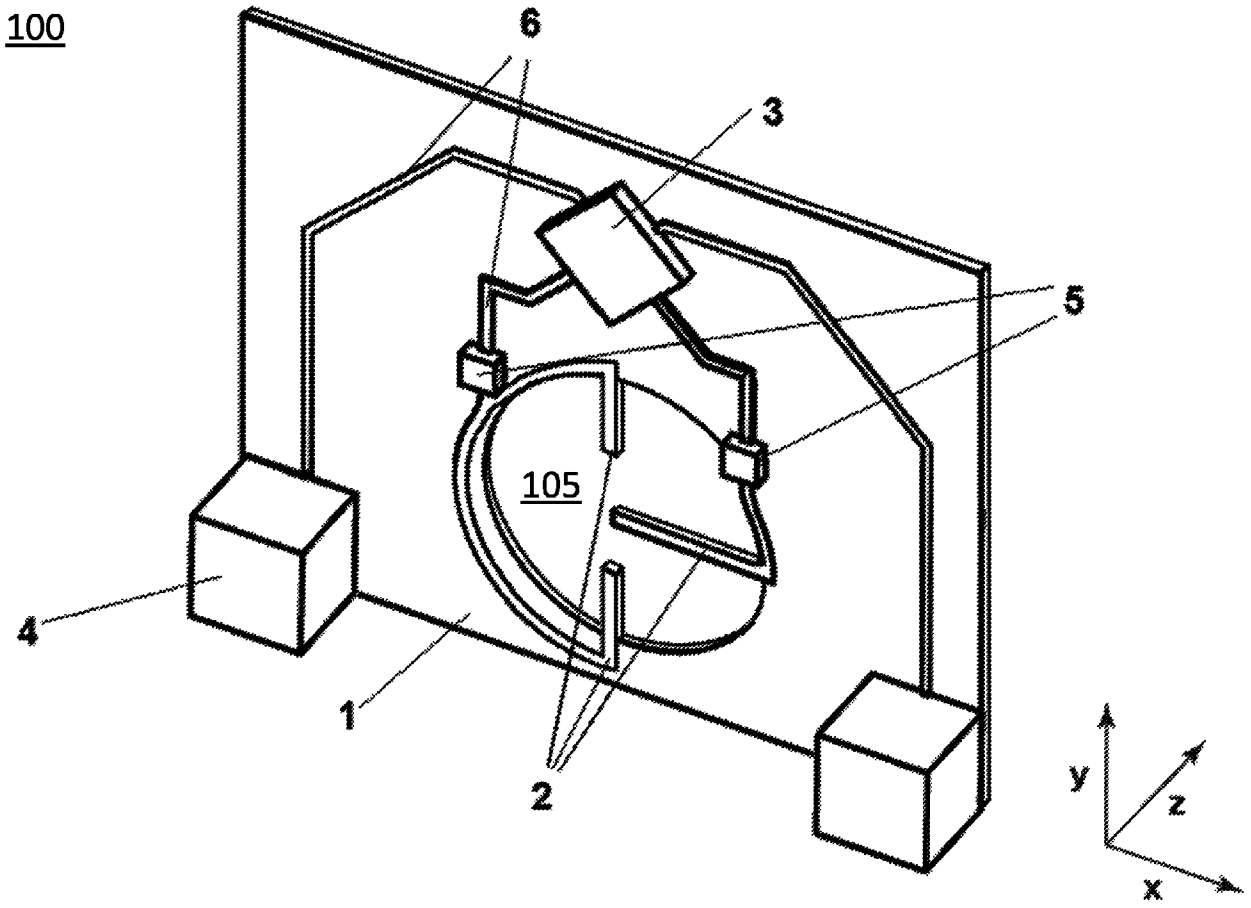
FIG. 1 is an illustration of an assembly for employment in a wireless station.

FIG. 1 is an illustration of an assembly 100 for employment in a wireless station, for example, a wireless station that operates in compliance with Institute of Electrical and Electronics Engineers (IEEE) 802.11. Assembly 100 includes a printed circuit board (PCB) 1 that holds components such as data ports 4, an integrated circuit 3, and radio frequency (RF) circuits 5, e.g., RF front ends, interconnected with PCB lines 6. PCB lines 6 are printed conductors, e.g., etched conductors. PCB 1 also has antenna elements 2 situated thereon. Antenna elements 2 are electrically coupled to RF circuits 5 via PCB lines 6, and are for radiating and/or receiving an RF signal. Thus, antenna elements 2 may be regarded as a radiating antenna element and/or a receiving antenna element.

In assembly 100, antenna elements 2 are integrated onto PCB 1, for example, by way of etching. That is, antenna elements 2 are etched elements, formed directly by PCB lines 6, e.g., a thin layer of copper. Antenna elements 2 can be also formed by conductive elements being attached to PCB 1 in a manner other than etching. In assembly 100, antenna elements 2 are relatively long in one dimension, and thin in another dimension, i.e., they are pin-shaped, but they may be configured of any appropriate shape for RF signal propagation.

In assembly 100, PCB 1 includes an aperture 105, where end portions of antenna elements 2 are on slivers of PCB 1 that extend into aperture 105.

Figure 2:
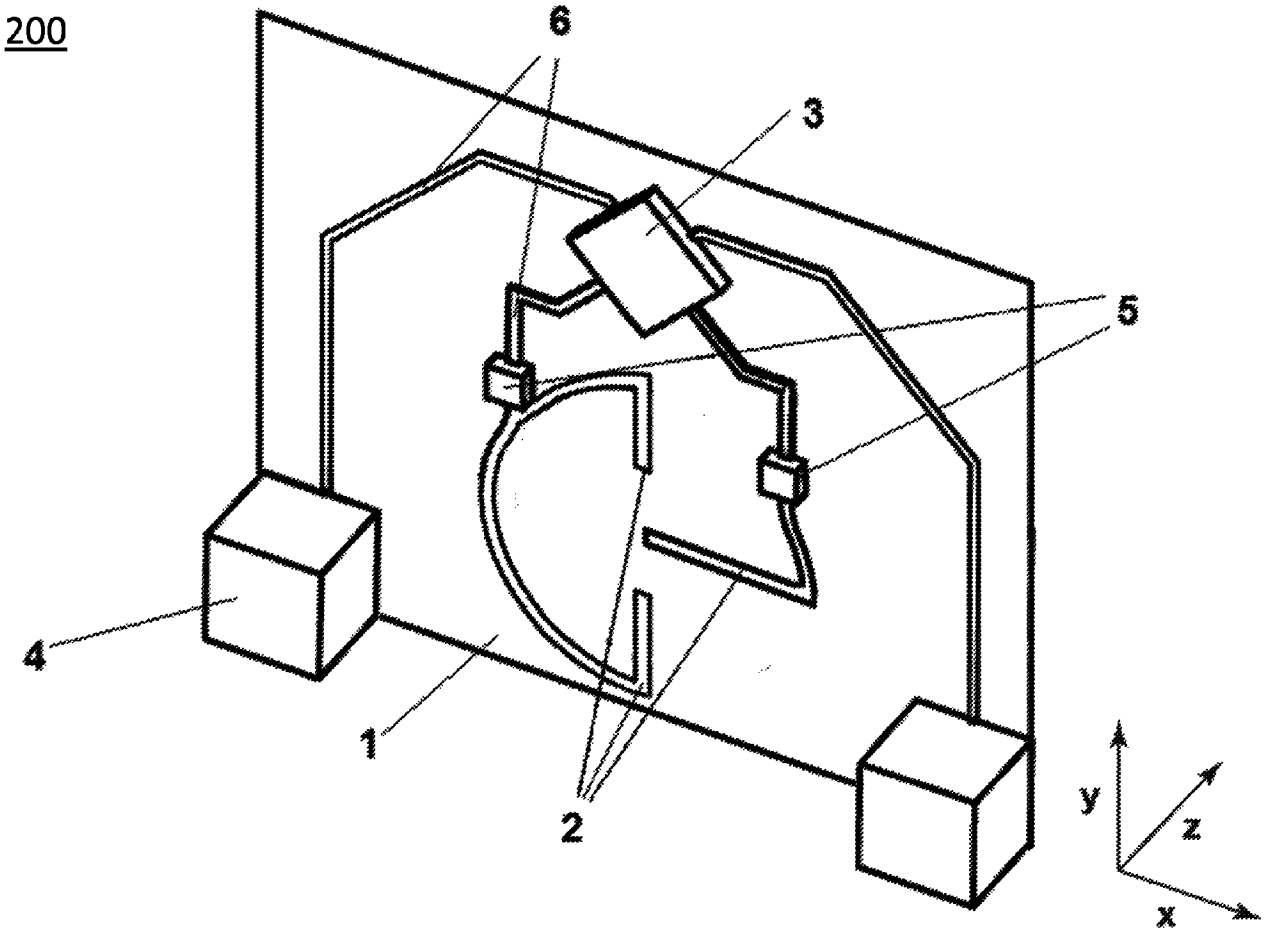
FIG. 2 is an illustration of another assembly for employment in a wireless station.

FIG. 2 is an illustration of an assembly 200 that is identical to assembly 100, except that assembly 200 does not include aperture 105.

Either of assembly 100 or assembly 200 can be configured with a single antenna element 2, or plurality of antenna elements 2. The plurality of antenna elements 2 would be used, for example, in a case of multiple orthogonal polarizations. Antenna elements 2 can be placed in aperture 105, as in assembly 100, or can be placed on a solid dielectric PCB structure, as in assembly 200

Figure 3:
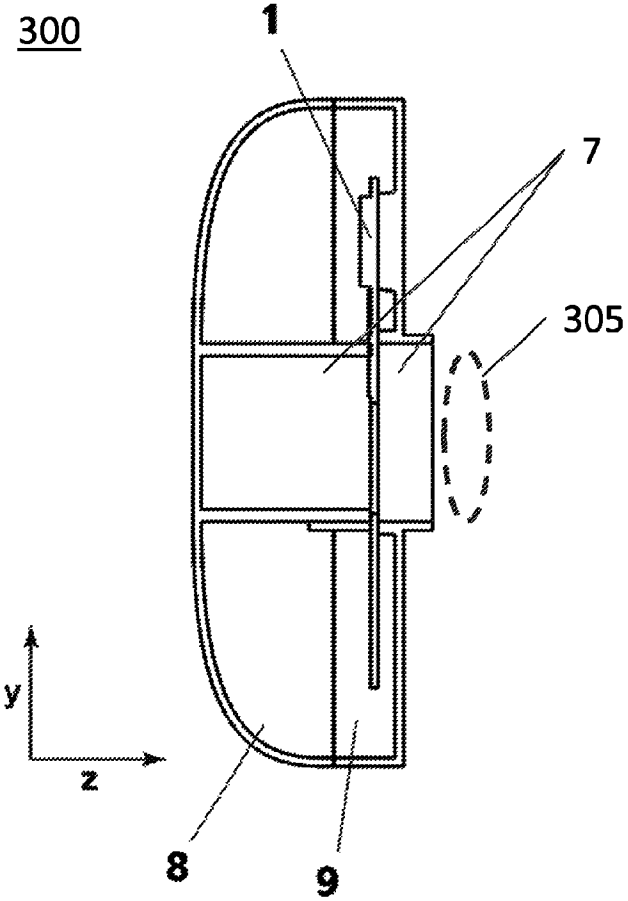
FIG. 3 is a side section view of a wireless station.

FIG. 3 is a side section view of a wireless station 300, i.e., a wireless communication apparatus, that contains PCB 1, i.e., either of assembly 100 or assembly 200. Wireless station 300 includes a housing formed by a housing section 8 and a housing section 9 that mate with one another to contain and hold PCB 1, and can also serve as a heat sink for integrated circuit 3 and RF circuits 5. Antenna elements 2 function as excitation probe(s) of transition from PCB lines 6 to a waveguide 7 that is formed when housing section 8 and housing section 9 are mated.

Waveguide 7 guides an RF signal between antenna element 2 and a region 305, i.e., a region of space. In operation, an RF signal radiated by antenna elements 2 propagates along waveguide 7, and exits wireless station 300 in the direction of the z-axis, i.e., toward region 305. Conversely, a signal entering waveguide 7 from region 305 will be guided to, and received by, antenna elements 2.

Wireless station 300 can operate as a stand-alone device. However, characteristic of wireless station 300, such as beam width, gain or radiation pattern, can be modified or improved by a mechanical structure, e.g., an antenna structure, that is attached to or otherwise interfaces with waveguide 7. The antenna structure can be of a shape and size required for a desired radiating property or radiation pattern. The antenna structure is optional, and would be used, for example, in a situation where higher gain and/or a particular radiation pattern is desired. Below, there are presented two examples of such an antenna structure, namely a parabolic antenna structure and a horn antenna structure.

However, other examples include a dielectric lens antenna structure, a Fresnel lens antenna structure, and a patch array antenna structure, but in general, wireless station 300 can be utilized with any suitable antenna structure.

FIGS. 4A-4C are exploded views of an apparatus 400 that utilizes wireless station 300. Apparatus 400 includes a parabolic antenna structure 10 that functions as a Cassegrain antenna.

Figure 5:
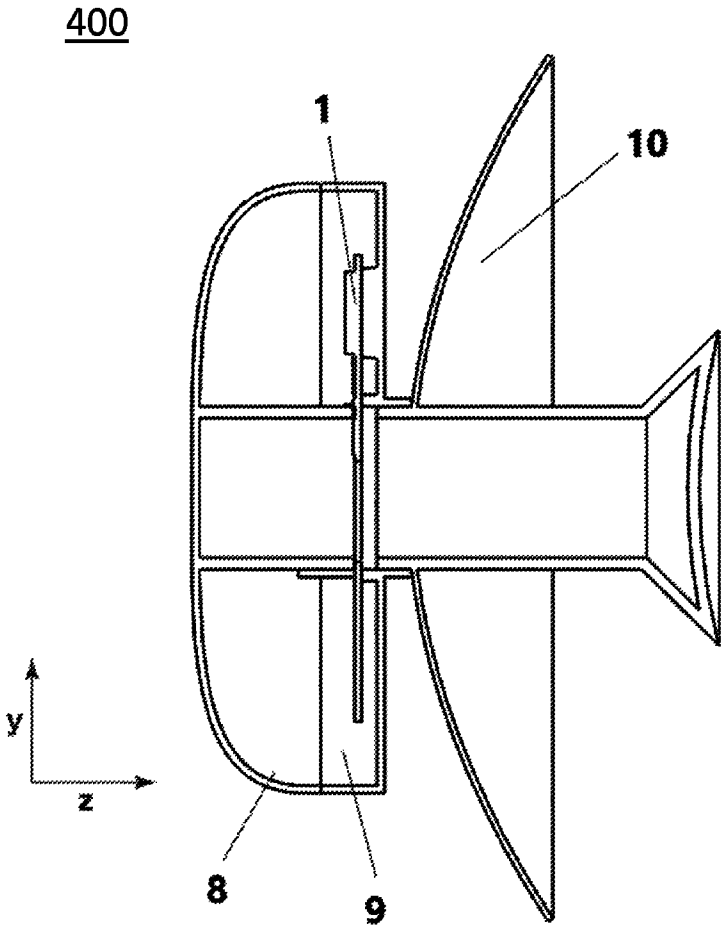
FIG. 5 is a side section view of the apparatus of FIG. 4A.

FIG. 5 is a side section view of apparatus 400.

Figure 6:
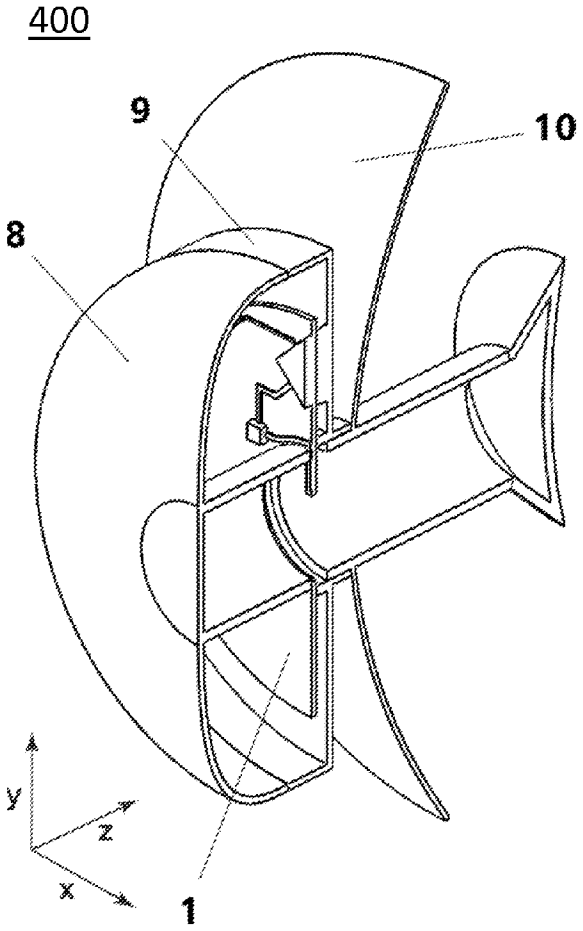
FIG. 6 is a cut-away view of the apparatus of FIG. 4A.

FIG. 6 is a cut-away view of apparatus 400, from behind, and shows a portion of PCB 1 situated therein.

Figure 7:
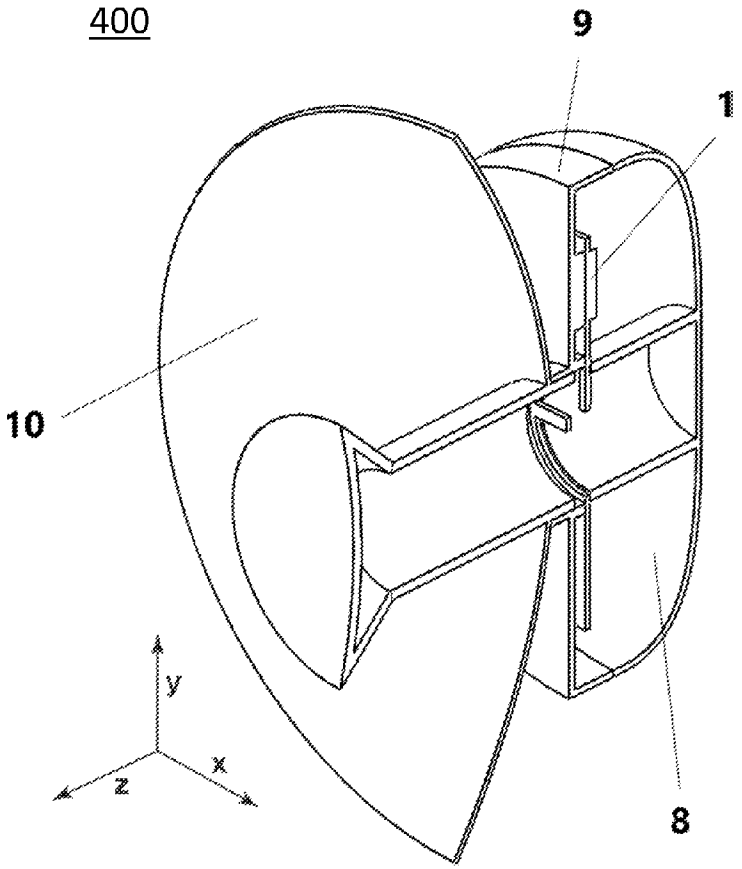
FIG. 7 is another cut-away view of the apparatus of FIG. 4A.

FIG. 7 is a cut-away view of apparatus 400, from the front.

Figure 8:
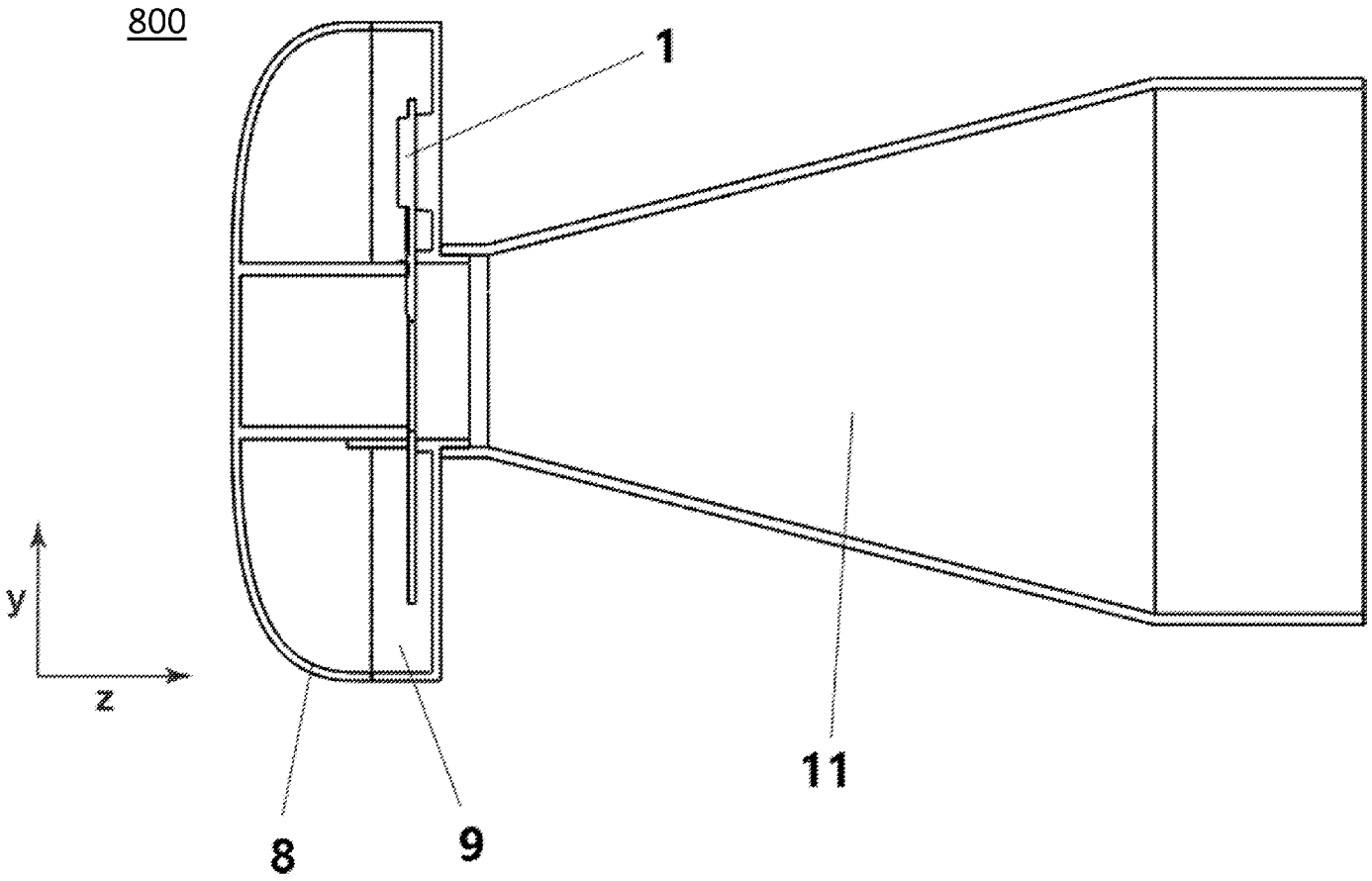
FIG. 8 is a side section view of another apparatus that utilizes the wireless station of FIG. 3.

FIG. 8 is a side section view of an apparatus 800 that utilizes wireless station 300. Apparatus 800 includes a horn antenna structure 11 that functions as a horn-style antenna.

Figure 9:
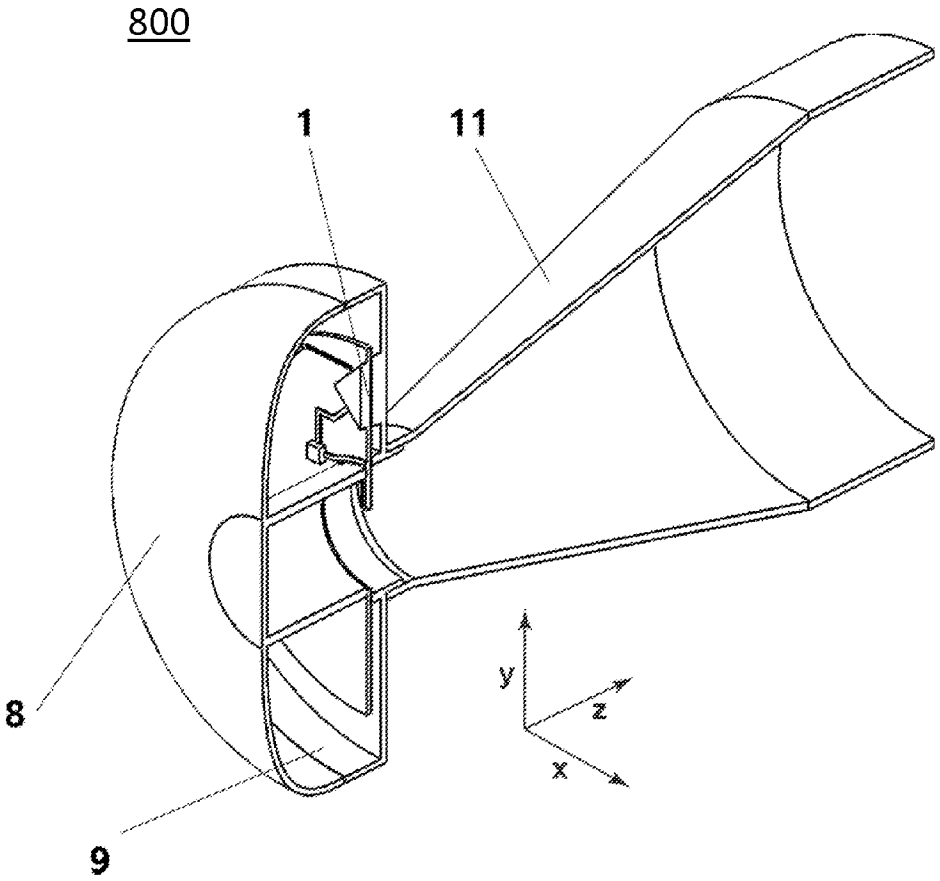
FIG. 9 is a cut-away view of the apparatus of FIG. 8.

FIG. 9 is a cut-away view of apparatus 800, from behind, and shows a portion of PCB 1 situated therein.

Figure 10:
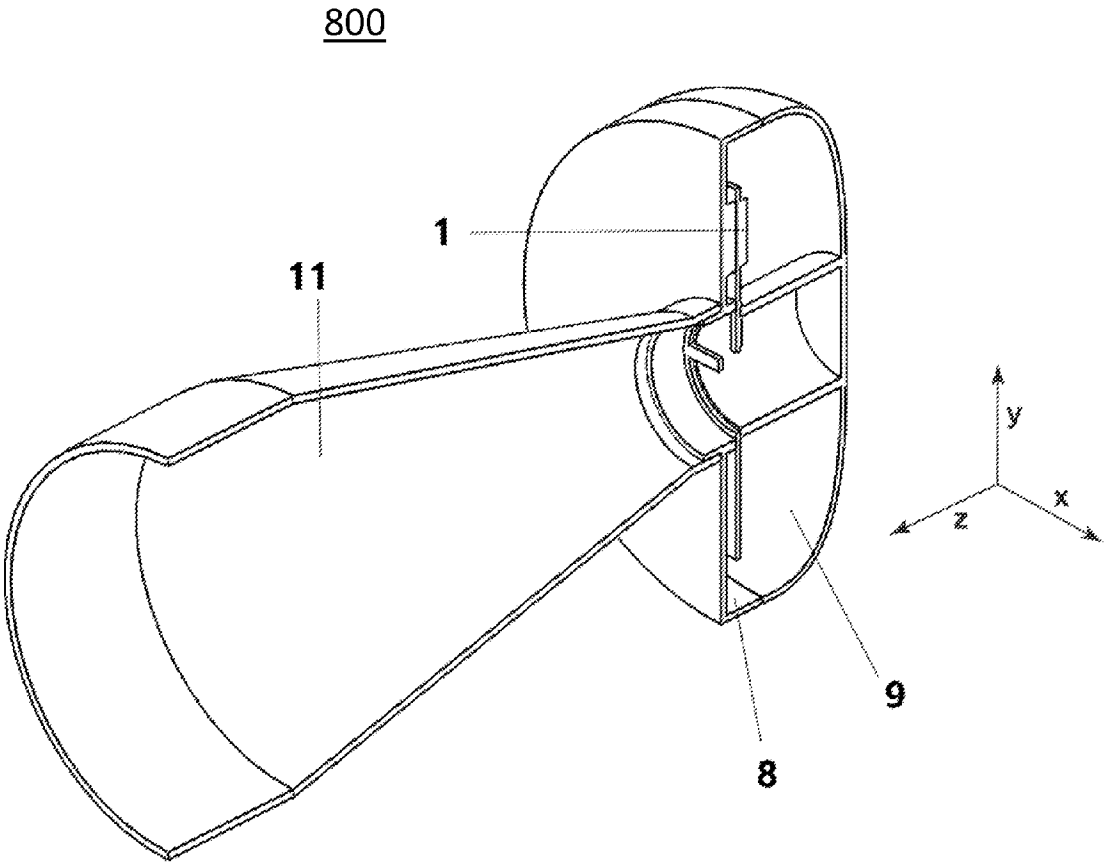
FIG. 10 is another cut-away view of the apparatus of FIG. 8.

FIG. 10 is a cut-away view of apparatus 800, from the front.

Figure 11:
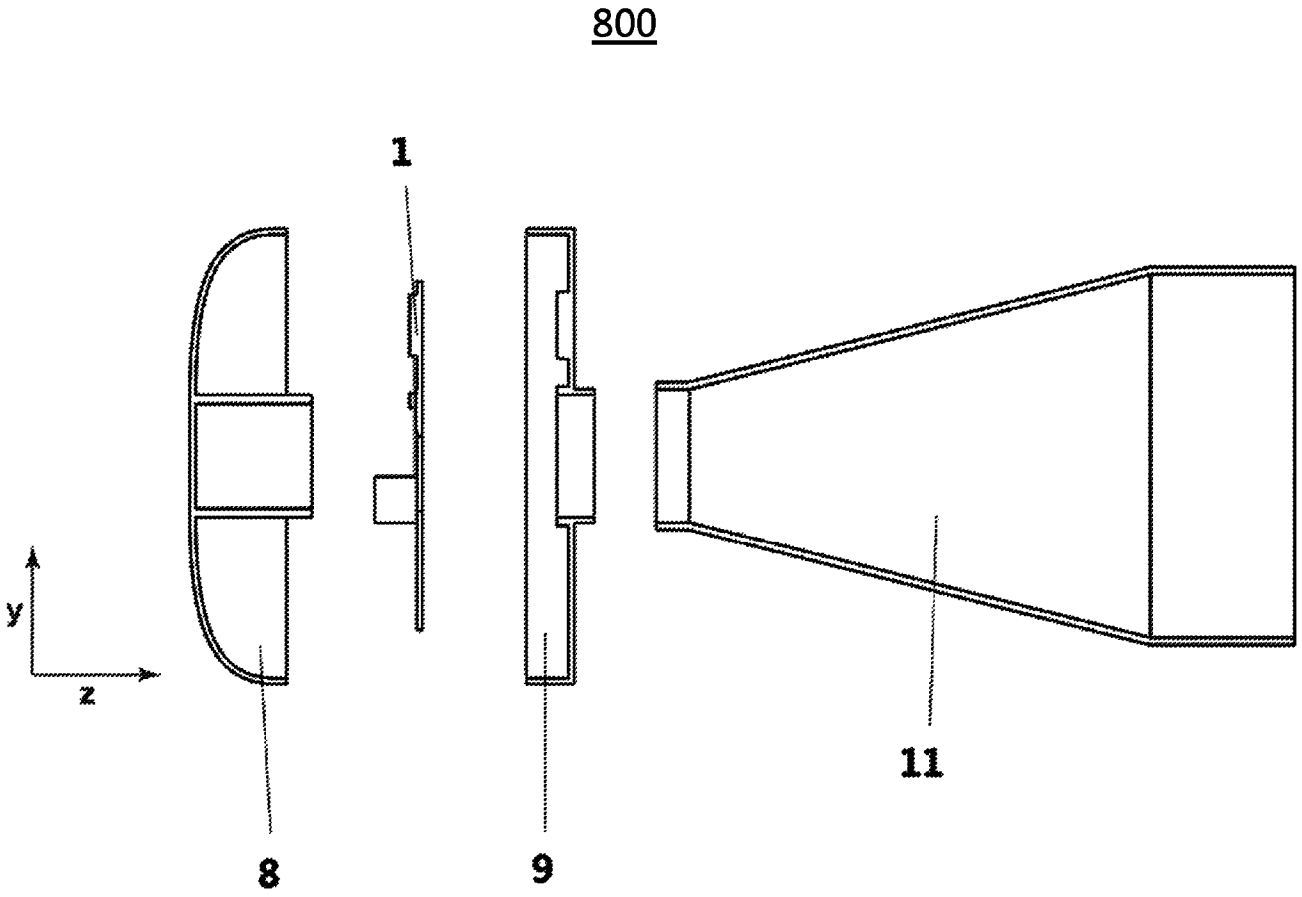
FIG. 11 is an exploded side view of the apparatus of FIG. 8.

FIG. 11 is an exploded side section view of apparatus 800.

Wireless station 300 does not require RF coaxial cables or RF connectors as are found in a typical IEEE 802.11 wireless station. Instead, in wireless station 300, antenna elements 2 are situated directly on PCB 1 and function as excitation probe(s) of transition from PCB lines 6 to waveguide 7. By integrating waveguide 7 and housing sections 8 and 9 into one structure, wireless station 300 achieves lower RF losses, a more compact form factor, i.e., reduced dimensions, and a decrease in cost, in comparison to a typical IEEE 802.11 wireless station.

Wireless station 300 may be configured as a module that can be used with any of a plurality of different antenna structures to provide different radiation properties. This modular configuration greatly simplifies manufacturing processes and logistics, shipping, and package design.

Moreover, whereas wireless station 300 can operate as a stand-alone device, or with any of a plurality of different antenna structures, wireless station 300 can be employed for "local" use, e.g., in a building, or for use over greater distances, e.g., kilometers.

Wireless station 300 is particularly well-suited for employment in an RF range of about 2 GHz-6.4 GHz, where GHz is an abbreviation for gigahertz, and as an IEEE 802.11 wireless station. However, wireless station 300 can be employed with any suitable frequency range, and is not limited to IEEE 802.11.

The terms "comprises" or "comprising" are to be interpreted as specifying the presence of the stated features, integers, steps or components, but not precluding the presence of one or more other features, integers, steps or components or groups thereof. The terms "a" and "an" are indefinite articles, and as such, do not preclude embodiments having pluralities of articles.

What is claimed is:

1. A wireless communication apparatus comprising:

a printed circuit board having a first surface;

a radio frequency circuit installed on said printed circuit board on said first surface;

an antenna element that is integrated onto said printed circuit board on said first surface and electrically coupled to said radio frequency circuit via a printed conductor; and a housing that (a) contains said printed circuit board, and (b) includes a waveguide that guides a signal between said antenna element and a region of space.

2. The wireless communication apparatus of claim 1, wherein said antenna element is a printed element on said printed circuit board.

3. The wireless communication apparatus of claim 1, further comprising an antenna structure that interfaces with said waveguide.

4. The wireless communication apparatus of claim 3, wherein said antenna structure influences a characteristic of said wireless communication apparatus selected from the group consisting of beam width, gain, and radiation pattern.

5. The wireless communication apparatus of claim 3, wherein said antenna structure is selected from the group consisting of a parabolic antenna structure, a horn antenna structure, a dielectric lens antenna structure, a Fresnel lens antenna structure, and a patch array antenna structure.

* * * * *